US011634798B2

(12) United States Patent
Yeh

(10) Patent No.: US 11,634,798 B2
(45) Date of Patent: Apr. 25, 2023

(54) LOW MODULUS CORROSION-RESISTANT ALLOY AND ARTICLE COMPRISING THE SAME

(71) Applicant: National Tsing Hua University, Hsinchu (TW)

(72) Inventor: Jien-Wei Yeh, Hsinchu (TW)

(73) Assignee: NATIONAL TSING HUA UNIVERSITY, Hsinchu (TW)

( * ) Notice: Subject to any disclaimer, the term of this patent is extended or adjusted under 35 U.S.C. 154(b) by 0 days.

(21) Appl. No.: 17/351,231

(22) Filed: Jun. 18, 2021

(65) Prior Publication Data

US 2022/0235439 A1 Jul. 28, 2022

(30) Foreign Application Priority Data

Jan. 27, 2021 (TW) ..... 110102925

(51) Int. Cl.

| | |
|---|---|
| ***C22C 30/04*** | (2006.01) |
| ***C22C 16/00*** | (2006.01) |
| ***C22C 30/02*** | (2006.01) |
| ***C22C 1/02*** | (2006.01) |

(52) U.S. Cl.

CPC ..... *C22C 30/04* (2013.01); *C22C 16/00* (2013.01); *C22C 30/02* (2013.01); *C22C 1/02* (2013.01)

(58) Field of Classification Search

None

See application file for complete search history.

(56) References Cited

U.S. PATENT DOCUMENTS 9,828,655 B2 11/2017 Hussein et al.

FOREIGN PATENT DOCUMENTS

| | | | |
|---|---|---|---|
| CN | 105734312 A | * | 7/2016 |
| CN | 106834855 A | * | 6/2017 |
| CN | 107893176 A | * | 4/2018 |
| EP | 0437079 | | 7/1991 |
| JP | 2020084300 A | * | 6/2020 |

OTHER PUBLICATIONS

English language machine translation of CN-105734312-A. Generated Jun. 17, 2022. (Year: 2022).*

English language machine translation of CN-106834855-A. Generated Jun. 17, 2022. (Year: 2022).*

English language machine translation of CN-107893176-A. Generated Jun. 17, 2022. (Year: 2022).*

English language machine translation of JP-2020084300-A. Generated Jun. 17, 2022. (Year: 2022).*

* cited by examiner

*Primary Examiner* — Brian D Walck

(57) ABSTRACT

A low modulus corrosion-resistant alloy is disclosed, and comprises five principal elements, wherein the five principal elements are Zr, Nb, Ti, Mo, and Sn. Experimental data reveal that, samples of the low modulus corrosion-resistant alloy all include following characteristics: hardness of at least 250 HV, Young's modulus less than 100 GPa, yield strength greater than 600 MPa, and critical pitting potential greater than 1.3V. As a result, experimental data have proved that this low modulus corrosion-resistant alloy has a significant potential for application in the manufacture of biomedical articles including medical devices and surgical implants. In addition, this low modulus corrosion-resistant alloy is also suitable for application in the manufacture of various industrially-producible articles, including springs, coils, wires, clamps, fasteners, blades, valves, elastic sheets, spectacle frames, sports equipment, and other high-strength low-modulus corrosion-resistant structural materials.

12 Claims, No Drawings

LOW MODULUS CORROSION-RESISTANT ALLOY AND ARTICLE COMPRISING THE SAME

BACKGROUND OF THE INVENTION

1. Field of the Invention

The present invention relates to the technology field of alloy materials, and more particularly to a low modulus corrosion-resistant alloy and an article comprising the same.

2. Description of the Prior Art

Biomedical articles and devices are made of polymer materials, alloys, or ceramic materials, and are used in regenerative medicine approaches to replace or restore organ (or tissue) in human body so as to support proper working of the organ (or tissue). Nowadays, biomedical alloys have been classified into stainless steels, cobalt-based alloys and titanium-based alloys, wherein stainless steels are the early-developed biomedical metal materials because of having advantages of easy to be processed, inexpensive cost and high yield strength.

Stainless steel is an alloy comprising Fe and Cr, C, and other elements, and the content of Cr in the stainless steel is at least 11 wt %. Type 304 (18Cr-8Ni) stainless steel is the most common biomedical alloy for application in the manufacture of bone screw and bone plate. As explained in more detail below, 18 and 8 are numeric values of Cr and Ni in weight percent, respectively. Compared to type 304 stainless steel, type 316 stainless steel exhibits better resistances of acid, corrosion and high-temperature because of further containing 2-3 wt % Mo. On the other hand, type 316L stainless steel is developed and produced by lowering the content of carbon in the type 316 stainless steel from 0.08 wt % to 0.03 wt %. Nowadays, type 316L stainless steels have been widely applied in the manufacture of artificial knee joint and hip joint. Clinic researches have indicated that, after a biomedical implant (such as a hip joint) made of type 316L stainless steel is implanted into the human body for a specific time, wear or corrosion of articulating surfaces of the type 316L stainless steel would lead metal ions to be released into blood or tissue in the human body, thereby eventually inducing adverse biological responses. Moreover, clinic researches have also found that, properties of high density and Young's modulus of a biomedical implant made of 316L type stainless steel are the critical factors causing stress shielding effect to the bone.

Cobalt-based alloy is an alloy comprising Co, Cr, Mo, and other elements, and has corrosion resistance greater than that of the forgoing stainless steel by fortyfold. There are fundamentally two types of cobalt-based alloys: (a) castable Co—Cr—Mo alloys and (b) Co—Ni—Cr—Mo alloy usually wrought by (hot) forging. Furthermore, the ASTM lists four types of cobalt-based alloys that are recommended for surgical implant applications: (1) cast Co—Cr—Mo alloy (F75), (2) wrought Co—Cr—W—Ni alloy (F90), (3) wrought Co—Ni—Cr—Mo alloy (F562), and (4) wrought Co—Ni—Cr—Mo—W—Fe alloy (F563). For example, Co-28Cr-6Mo alloy is the most common biomedical cobalt-based alloy for application in the manufacture of artificial hip joint, knee joint, bone plate, bone screw, and spicule. However, clinic researches have indicated that, after an artificial hip joint made of Co-28Cr-6Mo alloy has been implanted into a patient's body for 2-3 years, the patient responded to his attending doctor that he can feel the occurrence of hip dislocation and a sense of pain from the implanting position of the artificial hip joint. As described in more detail below, the Co-28Cr-6Mo alloy possesses density of 8.25 g/cm$^3$ and Young's modulus of 220 GPa, such that the Co-28Cr-6Mo alloy is less mechanically compatible with bone compared to the 316L type stainless steel.

Titanium and Titanium-based alloy both have density of 4.4-4.5 g/cm$^3$ that is significantly less than the density (8.0-8.25 g/cm$^3$) of the forgoing cobalt-based alloys and type 316L stainless. Nowadays, titanium-based alloys have been known to be superior to other metallic implant biomaterials by comparing their specific strength (i.e. the ratio between yield strength and density). In the human body environment, a passive film (mainly consisted of $TiO_2$) would spontaneously form on the surface of a titanium-based alloy, so as to in turn lead to a high corrosion resistance for protecting the underlying substrate from being subject to corrosion. Therefore, titanium-based alloy is more tolerant than the forgoing type 316L stainless steel and cobalt-based alloy.

As aforementioned, titanium is non-toxic for the human body and has high biocompatibility. Combined these advantages, titanium and titanium-based alloy provide a better solution to the problems of biomedical implants in the human body. For example, the Ti-6Al-4V alloy has been applied in the manufacture of bone implants. However, the oxide (i.e., $TiO_2$ and $Al_2O_3$) film of the Ti-6Al-4V alloy has porosity, such that the oxide film is easily subject to grain fracture and layer peeling, thereby resulting in serious oxidation wear and delamination wear. As a result, the Ti-6Al-4V alloy exhibits shortcomings of inadequate strength and wear resistance compared to the cobalt-based alloy and the type 316L stainless steel. In addition, because Young's modulus of bone and biomedical implant made of Ti-6Al-4V alloy are respectively 30 GPa and 116 GPa, the Young's modulus difference between bone and the Ti-6Al-4V alloy is easy to induce stress shielding effect to the bone.

From the above descriptions, it is understood that the conventional biomedical alloys have the following drawbacks in the practical application of biomedical implants:

(1) having inadequate strength and wear resistance;

(2) having high Young's modulus that is easy to induce stress shielding effect to the bone; and (3) having inadequate corrosion resistance.

In other words, there are rooms for improvement in the conventional biomedical alloys. In view of that, the inventor of the present application have made great efforts to make inventive research and eventually provided a low modulus corrosion-resistant alloy and an article comprising the same.

SUMMARY OF THE INVENTION

The primary objective of the present invention is to disclose a low modulus corrosion-resistant alloy comprising five principal elements, wherein the five principal elements are Zr, Nb, Ti, Mo, and Sn. According to the present invention, the low modulus corrosion-resistant alloy consists of Zr more than 31 wt %, 18-50 wt % Nb, 10-40 wt % Ti, 4-10 wt % Mo, and 1.5-15 wt % Sn, wherein a summation of Zr and Ti in weight percent is less than or equal to 80. It is worth mentioning that, experimental data have revealed that, samples of the low modulus corrosion-resistant alloy all include following characteristics: hardness of at least 250 HV, Young's modulus less than 100 GPa, yield strength greater than 600 MPa, and critical pitting potential greater than 1.3V. As a result, experimental data have proved that the low modulus corrosion-resistant alloy has a significant potential for application in the manufacture of biomedical articles including medical devices and surgical implants. In addition, this low modulus corrosion-resistant alloy is also suitable for application in the manufacture of various industrially-producible articles, including springs, coils, wires, clamps, fasteners, blades, valves, elastic sheets, spectacle frames, sports equipment, and other high-strength low-modulus corrosion-resistant structural materials.

In order to achieve the primary objective of the present invention, the inventor of the present invention provides a first embodiment of the low modulus corrosion-resistant alloy, which has a plurality of properties that comprises: hardness of at least 250 HV, Young's modulus less than 100 GPa, yield strength greater than 600 MPa, and critical pitting potential greater than 1.3V, and has an elemental composition of xZr-yNb-zTi-aMo-bSn;

wherein x, y, z, a, and b are numeric values of Zr, Nb, Ti, Mo, and Sn in weight percent, respectively; and wherein x, y, z, a, and b satisfy $x \geq 31$, $18 \leq y \leq 50$, $10 \leq z \leq 40$, $4 \leq a \leq 10$, $1.5 \leq b \leq 15$, and $x+z \leq 80$.

For achieving the objective of the present invention, the inventor of the present invention further provides a second embodiment of the low modulus corrosion-resistant alloy, which has a plurality of properties that comprises: hardness of at least 250 HV, Young's modulus less than 100 GPa, yield strength greater than 600 MPa, and critical pitting potential greater than 1.3V, and has an elemental composition of xZr-yNb-zTi-aMo-bSn-sM;

wherein M means at least one additive element selected from a group consisting of Hf, Ta, Pt, Ag, Au, Al, V, Ni, Cu, Co, C, and 0;

wherein x, y, z, a, b, and s are numeric values of Zr, Nb, Ti, Mo, Sn, and M in weight percent, respectively; and wherein x, y, z, a, b, and s satisfy $x \geq 31$, $18 \leq y \leq 50$, $10 \leq z \leq 40$, $4 \leq a \leq 10$, $1.5 \leq b \leq 15$, $s \leq 5$, and $x+z \leq 80$.

In order to achieve the primary objective of the present invention, the inventor of the present invention provides a third embodiment of the low modulus corrosion-resistant alloy, which has a plurality of properties that comprises: hardness of at least 250 HV, Young's modulus less than 100 GPa, yield strength greater than 600 MPa, and critical pitting potential greater than 1.3V, and has an elemental composition of xZr-yNb-zTi-aMo-bSn-cFe;

wherein x, y, z, a, b, and c are numeric values of Zr, Nb, Ti, Mo, Sn, and Fe in weight percent, respectively; and wherein x, y, z, a, b, and c satisfy $x \geq 31$, $18 \leq y \leq 50$, $10 \leq z \leq 40$, $4 \leq a \leq 10$, $1.5 \leq b \leq 15$, $c \leq 5$, and $x+z \leq 80$.

For achieving the objective of the present invention, the inventor of the present invention further provides a fourth embodiment of the low modulus corrosion-resistant alloy, which has a plurality of properties that comprises: hardness of at least 250 HV, Young's modulus less than 100 GPa, yield strength greater than 600 MPa, and critical pitting potential greater than 1.3V, and has an elemental composition of xZr-yNb-zTi-aMo-bSn-cFe-sM;

wherein M means at least one additive element selected from a group consisting of Hf, Ta, Pt, Ag, Au, Al, V, Ni, Cu, Co, C, and 0;

wherein x, y, z, a, b, c, and s are numeric values of Zr, Nb, Ti, Mo, Sn, Fe, and M in weight percent, respectively; and wherein x, y, z, a, b, c and s satisfy $x \geq 31$, $18 \leq y \leq 50$, $10 \leq z \leq 40$, $4 \leq a \leq 10$, $1.5 \leq b \leq 15$, $c \leq 5$, $s \leq 5$, and $x+z \leq 80$.

In one embodiment, the principal crystal structure of the low modulus corrosion-resistant alloy which is processed to be an as-cast state, an as-rolled state, or, an as-annealed state all being body-centered cubic (BCC) structure.

In the practicable embodiment, the low modulus corrosion-resistant alloy is produced by using a manufacturing method selected from a group consisting of: vacuum arc melting method, electric resistance wire heating method, electric induction heating method, rapidly solidification method, mechanical alloying method, and powder metallurgic method.

In the practicable embodiment, the low modulus corrosion-resistant alloy is processed to be an article selected from a group consisting of powder article, wire article, rod article, plate article, bulk article, and welding rod.

Moreover, the present invention also discloses an article, which is selected from a group consisting of surgical implant, medical device and industrially-producible product, and is made of the forgoing modulus corrosion-resistant alloy. In one embodiment, the industrially-producible product is selected from a group consisting of spring, coil, wire, clamp, fastener, blade, valve, elastic sheet, spectacle frame, sports equipment, and other high-strength low-modulus corrosion-resistant structural materials.

DETAILED DESCRIPTION OF THE PREFERRED EMBODIMENTS

To more clearly describe a low modulus corrosion-resistant alloy and an article comprising the same, embodiments of the present invention will be described in detail with reference to the attached data hereinafter.

The present invention using three elements with good biocompatibility and two elements with medium biocompatibility to form a low modulus corrosion-resistant alloy. In which, the forgoing three elements with good biocompatibility are Zr, Nb and Ti, and the forgoing two elements with medium biocompatibility are Mo and Sn. As described in more detail below, the low modulus corrosion-resistant alloy comprising: greater than or equal to 31 wt % Zr, from 18 to 50 wt % Nb, from 10 to 40 wt % Ti, from 4 to 10 wt % Mo, and from 1.5 to 15 wt % Sn, and a summation of numeric values of Zr and Ti in weight percent is less than or equal to 80. In the practicable embodiment, the principal crystal structure of the low modulus corrosion-resistant alloy all being body-centered cubic (BCC) structure. According to measurement data, the low modulus corrosion-resistant alloy has a plurality of specific properties, comprising: hardness of at least 250 HV, Young's modulus less than 100 GPa, yield strength greater than 600 MPa, and critical pitting potential greater than 1.3V.

First Embodiment

In first embodiment, the low modulus corrosion-resistant alloy is designed to have an elemental composition of xZr-yNb-zTi-aMo-bSn, so as to exhibit a plurality of specific properties that comprises: hardness of at least 250 HV, Young's modulus less than 100 GPa, yield strength greater than 600 MPa, and critical pitting potential greater than 1.3V. As described in more detail below, the forgoing x, y, z, a, and b are numeric values of Zr, Nb, Ti, Mo, and Sn in weight percent, respectively. Moreover, x, y, z, a, and b satisfy $x \geq 31$, $18 \leq y \leq 50$, $10 \leq z \leq 40$, $4 \leq a \leq 10$, $4 \leq a \leq 10$, $1.5 \leq b \leq 15$, and $x+z \leq 80$. For example, the low modulus corrosion-resistant alloy is designed to comprises: 31 wt % Zr, 45.8 wt % Nb, 16.3 wt % Ti, 4.9 wt % Mo, and 2 wt % Sn. In such case, the low modulus corrosion-resistant alloy has an elemental composition of 31Zr-45.8Nb-16.3Ti-4.9Mo-2Sn. That is, x=31, y=45.8, z=16.3, a=4.9, and b=2.

Second Embodiment

In second embodiment, the low modulus corrosion-resistant alloy is designed to have an elemental composition of xZr-yNb-zTi-aMo-bSn-sM, thereby showing a plurality of specific properties comprising: hardness of at least 250 HV, Young's modulus less than 100 GPa, yield strength greater than 600 MPa, and critical pitting potential greater than 1.3V. As explained in more detail below, M means at least one additive element selected from a group consisting of Hf, Ta, Pt, Ag, Au, Al, V, Ni, Cu, Co, C, and O. On the other hand, the forgoing x, y, z, a, b, and s are numeric values of Zr, Nb, Ti, Mo, Sn, and M in weight percent, respectively. Moreover, x, y, z, a, b, and s satisfy $x \geq 31$, $18 \leq y \leq 50$, $10 \leq z \leq 40$, $4 \leq a \leq 10$, $1.5 \leq b \leq 15$, and $x+z \leq 80$. For example, the low modulus corrosion-resistant alloy is designed to comprises: 45.7 wt % Zr, 18.4 wt % Nb, 19.5 wt % Ti, 4.3 wt % Mo, 7.1 wt % Sn, 2 wt % Al, and 1 wt % V. In such case, the low modulus corrosion-resistant alloy has an elemental composition of 45.7Zr-18.4Nb-19.5Ti-4.3Mo-7.1Sn-2Al-1V-1Ni-1Pt. That is, x=45.7, y=18.4, z=19.5, a=4.3, b=7.1, and s=5.

Third Embodiment

In third embodiment, the low modulus corrosion-resistant alloy is designed to have an elemental composition of xZr-yNb-zTi-aMo-bSn-cFe, so as to exhibit a plurality of specific properties that comprises: hardness of at least 250 HV, Young's modulus less than 100 GPa, yield strength greater than 600 MPa, and critical pitting potential greater than 1.3V. As described in more detail below, the forgoing x, y, z, a, b, and c are numeric values of Zr, Nb, Ti, Mo, Sn, and Fe in weight percent, respectively. Moreover, x, y, z, a, b, and c satisfy $x \geq 31$, $18 \leq y \leq 50$, $10 \leq z \leq 40$, $4 \leq a \leq 10$, $1.5 \leq b \leq 15$, and $x+z \leq 80$. For example, the low modulus corrosion-resistant alloy is designed to comprises: 53 wt % Zr, 21.6 wt % Nb, 15.9 wt % Ti, 4.8 wt % Mo, 4 wt % Sn, and 0.7 wt % Fe. In such case, the low modulus corrosion-resistant alloy has an elemental composition of 53Zr-21.6Nb-15.9Ti-4.8Mo-4Sn-0.7Fe. That is, x=53, y=21.6, z=15.9, a=4.8, b=4, and c=0.7.

Fourth Embodiment

In fourth embodiment, the low modulus corrosion-resistant alloy is designed to have an elemental composition of xZr-yNb-zTi-aMo-bSn-cFe-sM, thereby showing a plurality of specific properties comprising: hardness of at least 250 HV, Young's modulus less than 100 GPa, yield strength greater than 600 MPa, and critical pitting potential greater than 1.3V. As explained in more detail below, M means at least one additive element selected from a group consisting of Hf, Ta, Pt, Ag, Au, Al, V, Ni, Cu, Co, C, and O. On the other hand, the forgoing x, y, z, a, b, c, and s are numeric values of Zr, Nb, Ti, Mo, Sn, Fe, and M in weight percent, respectively. Moreover, x, y, z, a, b, c, and s satisfy $x \geq 31$, $18 \leq y \leq 50$, $10 \leq z \leq 40$, $4 \leq a \leq 10$, $1.5 \leq b \leq 15$, $c \leq 5$, $s \leq 5$, and $x+z \leq 80$. For example, the low modulus corrosion-resistant alloy is designed to comprises: 52 wt % Zr, 20.6 wt % Nb, 15.9 wt % Ti, 4.8 wt % Mo, 4 wt % Sn, 0.7 wt % Fe, 1 wt % Co, and 1 wt % Ta. In such case, the low modulus corrosion-resistant alloy has an elemental composition of 52Zr-20.6Nb-15.9Ti-4.8Mo-4Sn-0.7Fe-1Co-1Ta. That is, x=52, y=20.6, z=15.9, a=4.8, b=4, c=0.7, and s=2.

It is worth mentioning that, the low modulus corrosion-resistant alloy according to the present invention can be produced by using a manufacturing method selected from a group consisting of: vacuum arc melting method, electric resistance wire heating method, electric induction heating method, rapidly solidification method, mechanical alloying method, and powder metallurgic method. Moreover, the low modulus corrosion-resistant alloy can be processed to be an as-cast state, an as-rolled state or an as-annealed state in a practicable application, so as to be made to an article selected from a group consisting of powder article, wire article, rod article, plate article, bulk article, and welding rod.

Therefore, engineers skilled in the development and manufacture of alloys are certainly able to fabricate a specific article comprising the low modulus corrosion-resistant alloy according to the present invention, such as a surgical implant, a medical device, or an industrially-producible product. In practicable embodiments, the surgical implant can be an artificial hip joint, an artificial knee joint, a joint button, a bone plate, a bone screw, a spicule, a dental crown, an abutment post for supporting the dental crown, a bridge, a partial denture, etc. On the other hand, the medical device can be a scalpel's blade, a hemostatic forceps, a surgical scissor, an electric bone drill, a tweezer, a blood vessel suture needle, a sternum suture thread, and so on. Moreover, the industrially-producible product is like spring, coil, wire, clamp, fastener, blade, valve, elastic sheet, spectacle frame, sports equipment, and other high-strength low-modulus corrosion-resistant structural materials. As explained in more detail below, process way for achieving the fabrication of the specific article can be casting method, electric-arc welding method, thermal spraying method, thermal sintering method, laser welding method, plasma-arc welding method, 3D additive manufacturing method, mechanical process method, or chemical process method.

It is worth mentioning that, the inventor of the present invention has completed experiments in order to prove that the low modulus corrosion-resistant alloy according to the present invention can indeed be made.

First Experiment Example

In the first experiment example, samples of the low modulus corrosion-resistant alloy according to the present invention are fabricated by using the vacuum arc melting method. Following Table (1) lists each sample's elemental composition. Moreover, tensile test, hardness measurement, microstructure analysis, and potentiodynamic polarization test for the samples of the low modulus corrosion-resistant alloy are also completed, and related measurement data are recorded in the following Table (2).

TABLE 1

| Samples | Elemental composition |
|---|---|
| No. 1 | 31Zr—45.8Nb—16.3Ti—4.9Mo—2Sn |
| No. 2 | 31Zr—45.8Nb—15.3Ti—4.9Mo—1.5Sn—1.5Fe |
| No. 3 | 35.7Zr—41.1Nb—16.3Ti—4.9Mo—2Sn |
| No. 4 | 35.7Zr—41.1Nb—14.3Ti—4.9Mo—1.5Sn—2.5Fe |
| No. 5 | 40.4Zr—36.4Nb—16.3Ti—4.9Mo—2Sn |
| No. 6 | 40.4Zr—36.4Nb—13.3Ti—4.9Mo—1.5Sn—3.5Fe |
| No. 7 | 45.1Zr—31.7Nb—16.3Ti—4.9Mo—2Sn |
| No. 8 | 45.1Zr—31.7Nb—13.3Ti—4.9Mo—1.5Sn—3.5Fe |
| No. 9 | 54.5Zr—22.2Nb—16.3Ti—5Mo—2Sn |
| No. 10 | 54.5Zr—22.2Nb—12.8Ti—5Mo—1.5Sn—4Fe |
| No. 11 | 52Zr—21.1Nb—15.6Ti—9.4Mo—1.9Sn |
| No. 12 | 52Zr—21.1Nb—15.1Ti—9.4Mo—1.9Sn—0.5Fe |

TABLE 2

| Samples | Hardness (HV) | Young's modulus (GPa) | Yield strength (MPa) | Critical pitting potential (V) |
|---|---|---|---|---|
| No. 1 | 312 | 93.3 | 1040 | >1.3 |
| No. 2 | 341 | 98.1 | 1124 | >1.3 |
| No. 3 | 311 | 90.2 | 1035 | >1.3 |
| No. 4 | 345 | 97.8 | 1132 | >1.3 |
| No. 5 | 302 | 88.5 | 1006 | >1.3 |
| No. 6 | 344 | 94.3 | 1084 | >1.3 |
| No. 7 | 289 | 83.6 | 970 | >1.3 |
| No. 8 | 322 | 90.2 | 1036 | >1.3 |
| No. 9 | 282 | 77.8 | 946 | >1.3 |
| No. 10 | 312 | 86.5 | 998 | >1.3 |
| No. 11 | 331 | 94.3 | 1096 | >1.3 |
| No. 12 | 342 | 97.4 | 1136 | >1.3 |

From the forgoing Table (2), it is easy to find that, 12 samples of the low modulus corrosion-resistant alloy all include following characteristics: hardness of at least 250 HV, Young's modulus less than 100 GPa, yield strength greater than 600 MPa, and critical pitting potential greater than 1.3V.

Second Experiment Example

In the second experiment example, samples of the low modulus corrosion-resistant alloy according to the present invention are fabricated by also using the vacuum arc melting method. Following Table (3) lists each sample's elemental composition. Moreover, tensile test, hardness measurement, microstructure analysis, and potentiodynamic polarization test for the samples of the low modulus corrosion-resistant alloy are also completed, and related measurement data are recorded in the following Table (4).

TABLE 3

| Samples | Elemental composition |
|---|---|
| No. 13 | 53.4Zr—21.8Nb—16Ti—4.8Mo—4Sn |
| No. 14 | 51.4Zr—20.8Nb—15Ti—4.8Mo—4Sn—2Al—2Ta |
| No. 15 | 51.4Zr—20.8Nb—14Ti—4.8Mo—4Sn—2V—1Ni—1Cu—1Pt |
| No. 16 | 51.4Zr—20.9Nb—15.5Ti—4.6Mo—7.6Sn |
| No. 17 | 49.4Zr—19.9Nb—14.5Ti—4.6Mo—7.6Sn—3Co—1Ag |
| No. 18 | 49.4Zr—19.9Nb—14.5Ti—4.6Mo—7.6Sn—1Al—1V—1Ni—1Au |
| No. 19 | 49.5Zr—20.2Nb—14.8Ti—4.5Mo—11Sn |
| No. 20 | 47.5Zr—19.2Nb—14.8Ti—4.5Mo—11Sn—3Cu |
| No. 21 | 47.5Zr—19.2Nb—12.8Ti—4.5Mo—11Sn—2Co—1C—1O—1Pt |
| No. 22 | 47.7Zr—19.5Nb—14.3Ti—4.3Mo—14.2Sn |
| No. 23 | 53Zr—21.6Nb—15.9Ti—4.8Mo—4Sn—0.7Fe |
| No. 24 | 52Zr—20.6Nb—15.9Ti—4.8Mo—4Sn—0.7Fe—1Co—1Ta |
| No. 25 | 51Zr—20.6Nb—13.9Ti—4.8Mo—4Sn—0.7Fe—2C—1O—1Al—1Pt |
| No. 26 | 52.7Zr—21.5Nb—15.8Ti—4.7Mo—3.9Sn—1.4Fe |
| No. 27 | 50.7Zr—20.5Nb—14.8Ti—4.7Mo—3.9Sn—1.4Fe—2V—2Ag |
| No. 28 | 50.7Zr—20.5Nb—14.3Ti—4.7Mo—3.9Sn—1.4Fe—2Ni—1Cu—1Co—0.5Au |
| No. 29 | 47.7Zr—19.4Nb—21.5Ti—4.3Mo—7.1Sn |
| No. 30 | 46.7Zr—18.4Nb—19.5Ti—4.3Mo—7.1Sn—2C—2Ta |
| No. 31 | 45.7Zr—18.4Nb—19.5Ti—4.3Mo—7.1Sn—2Al—1V—1Ni—1Pt |
| No. 32 | 44.6Zr—18.1Nb—26.7Ti—4Mo—6.6Sn |
| No. 33 | 42.6Zr—18.1Nb—24.7Ti—4Mo—6.6Sn—3Cu—1Ag |
| No. 34 | 42.6Zr—18.1Nb—23.7Ti—4Mo—6.6Sn—2Co—1Ni—1C—0.5O—0.5Au |

TABLE 4

| Samples | Hardness (HV) | Young's modulus (GPa) | Yield strength (MPa) | Critical pitting potential (V) |
|---|---|---|---|---|
| No. 13 | 286 | 79.9 | 961 | >1.3 |
| No. 14 | 318 | 85.1 | 1009 | >1.3 |
| No. 15 | 353 | 92.3 | 1123 | >1.3 |

TABLE 4-continued

| Samples | Hardness (HV) | Young's modulus (GPa) | Yield strength (MPa) | Critical pitting potential (V) |
|---|---|---|---|---|
| No. 16 | 318 | 88.2 | 1055 | >1.3 |
| No. 17 | 347 | 95.8 | 1116 | >1.3 |
| No. 18 | 356 | 97.2 | 1173 | >1.3 |
| No. 19 | 348 | 95.7 | 1104 | >1.3 |
| No. 20 | 368 | 98.9 | 1217 | >1.3 |
| No. 21 | 402 | 99.7 | 1230 | >1.3 |
| No. 22 | 391 | 99.8 | 1179 | >1.3 |
| No. 23 | 306 | 82.8 | 1021 | >1.3 |
| No. 24 | 323 | 87.3 | 1057 | >1.3 |
| No. 25 | 367 | 97.8 | 1163 | >1.3 |
| No. 26 | 337 | 91.3 | 1111 | >1.3 |
| No. 27 | 364 | 99.4 | 1159 | >1.3 |
| No. 28 | 367 | 98.7 | 1161 | >1.3 |
| No. 29 | 303 | 81.2 | 991 | >1.3 |
| No. 30 | 358 | 90.4 | 1072 | >1.3 |
| No. 31 | 372 | 95.6 | 1112 | >1.3 |
| No. 32 | 300 | 77.5 | 990 | >1.3 |
| No. 33 | 334 | 82.8 | 1032 | >1.3 |
| No. 34 | 388 | 97.5 | 1174 | >1.3 |

From the forgoing Table (4), it is easy to find that, 22 samples of the low modulus corrosion-resistant alloy all include following characteristics: hardness of at least 250 HV, Young's modulus less than 100 GPa, yield strength greater than 600 MPa, and critical pitting potential greater than 1.3V.

Third Experiment Example

In the third experiment example, samples No. 13 and No. 32 of the low modulus corrosion-resistant alloy of the present invention, a conventional type 316L stainless steel, a conventional Co-28Cr-6Mo alloy, and a conventional Ti-6Al-4V alloy are taken for further completing multi tests, and related measurement data are recorded in the following Table (5).

TABLE 5

| Test items | type 316L stainless steel | CoCrMo alloy | Ti—6Al—4V alloy | Sample No. 13 | Sample No. 32 |
|---|---|---|---|---|---|
| Density ($g/cm^3$) | 8.00 | 8.25 | 4.42 | 6.53 | 6.13 |
| Price (TWD/g) | 0.15 | 0.86 | 0.78 | 1.42 | 1.24 |
| Hardness (HV) | 155 | 300 | 348.7 | 286.0 | 300.0 |
| Yield strength (MPa) | 190 | 450 | 795 | 961 | 990 |
| Young's modulus (GPa) | 193 | 220 | 116 | 79.9 | 77.5 |
| Corrosion current ($A/cm^2$) | $3.2 \times 10^{-7}$ | $6.4 \times 10^{-8}$ | $2.1 \times 10^{-8}$ | $1.6 \times 10^{-8}$ | $1.9 \times 10^{-8}$ |
| Critical pitting potential (V) | 0.812 | 0.535 | >1.3 | >1.3 | >1.3 |

From the forgoing Table (5), it is easy to find that, samples No. 13 and No. 32 of the low modulus corrosion-resistant alloy both include characteristics of hardness of at least 250 HV, Young's modulus less than 100 GPa, yield strength greater than 600 MPa, and critical pitting potential greater than 1.3V. Therefore, experimental data have proved that, the low modulus corrosion-resistant alloy of the present invention exhibits outstanding mechanical property and corrosion resistance superior to that of the conventional type 316L stainless steel, Co-28Cr-6Mo alloy, and Ti-6Al-4V alloy.

Therefore, through the above descriptions, all embodiments and their experimental data of the low modulus corrosion-resistant alloy according to the present invention have been introduced completely and clearly; in summary, the present invention includes the advantages of:

(1) The present invention discloses a low modulus corrosion-resistant alloy comprising five principal elements, wherein the five principal elements are Zr, Nb, Ti, Mo, and Sn. According to the present invention, the low modulus corrosion-resistant alloy consists of Zr more than 31 wt %, 18-50 wt % Nb, 10-40 wt % Ti, 4-10 wt % Mo, and 1.5-15 wt % Sn, wherein a summation of Zr and Ti in weight percent is less than or equal to 80. It is worth mentioning that, experimental data have revealed that, samples of the low modulus corrosion-resistant alloy all include following characteristics: hardness of at least 250 HV, Young's modulus less than 100 GPa, yield strength greater than 600 MPa, and critical pitting potential greater than 1.3V.

(2) According to the experimental data, it is believed that the low modulus corrosion-resistant alloy of the present invention has a significant potential for application in the manufacture of biomedical articles including medical devices and surgical implants. In addition, this low modulus corrosion-resistant alloy is also suitable for application in the manufacture of various industrially-producible articles, including springs, coils, wires, clamps, fasteners, blades, valves, elastic sheets, spectacle frames, sports equipment, and other high-strength low-modulus corrosion-resistant structural materials.

The above description is made on embodiments of the present invention. However, the embodiments are not intended to limit the scope of the present invention, and all equivalent implementations or alterations within the spirit of the present invention still fall within the scope of the present invention.

What is claimed is:

1. A low modulus corrosion-resistant alloy, having a plurality of properties that comprises: hardness of at least 250 HV, Young's modulus in a range between 70 GPa and 100 GPa, yield strength greater than 600 MPa, and critical pitting potential greater than 1.3V, and comprising:

at least 40 weight percent Zr, 18.1 to 50 weight percent Nb, 13 to 40 weight percent Ti, 4 to 10 weight percent Mo, and 1.5 to 15 weight percent Sn;

wherein a summation of Zr and Ti in weight percent is less than or equal to 80.

2. The low modulus corrosion-resistant alloy of claim 1, wherein the principal crystal structure of the low modulus corrosion-resistant alloy which is processed to be an as-cast state, an as-rolled state, or an as-annealed state all being body-centered cubic (BCC) structure.

3. The low modulus corrosion-resistant alloy of claim 1, further comprising at most 5 weight percent M, wherein M comprises at least one additive element selected from a group consisting of Hf, Ta, Pt, Ag, Au, Al, V, Ni, Cu, Co, C, and O.

4. The low modulus corrosion-resistant alloy of claim 1, being produced by using a manufacturing method selected from a group consisting of: vacuum arc melting method, electric resistance wire heating method, electric induction heating method, rapidly solidification method, mechanical alloying method, and powder metallurgic method.

5. The low modulus corrosion-resistant alloy of claim 1, wherein the low modulus corrosion-resistant alloy is processed to be an article selected from a group consisting of powder article, wire article, rod article, plate article, bulk article, and welding rod.

6. An article, being made of an alloy material, wherein the alloy material has a plurality of properties that comprises: hardness of at least 250 HV, Young's modulus in a range between 70 GPa and 100 GPa, yield strength greater than 600 MPa, and critical pitting potential greater than 1.3V, and comprising:

at least 40 weight percent Zr, 18.1 to 50 weight percent Nb, 13 to 40 weight percent Ti, 4 to 10 weight percent Mo, and 1.5 to 15 weight percent Sn;

wherein a summation of Zr and Ti in weight percent is less than or equal to 80;

wherein the article is selected from a group consisting of surgical implant, medical device and industrially-producible product; and wherein the forgoing industrially-producible product is selected from a group consisting of spring, coil, wire, clamp, fastener, blade, valve, elastic sheet, spectacle frame, and sports equipment.

7. A low modulus corrosion-resistant alloy, having a plurality of properties that comprises: hardness of at least 250 HV, Young's modulus in a range between 70 GPa and 100 GPa, yield strength greater than 600 MPa, and critical pitting potential greater than 1.3V, and comprising:

at least 40 weight percent Zr, 18.1 to 50 weight percent Nb, 13 to 40 weight percent Ti, 4 to 10 weight percent Mo, 1.5 to 15 weight percent Sn, and at most 5 weight percent Fe;

wherein a summation of Zr and Ti in weight percent is less than or equal to 80.

8. The low modulus corrosion-resistant alloy of claim 7, wherein the principal crystal structure of the low modulus corrosion-resistant alloy which is processed to be an as-cast state, an as-rolled state, or an as-annealed state all being body-centered cubic (BCC) structure.

9. The low modulus corrosion-resistant alloy of claim 7, further comprising at most 5 weight percent M, wherein M comprises at least one additive element selected from a group consisting of Hf, Ta, Pt, Ag, Au, Al, V, Ni, Cu, Co, C, and O.

10. The low modulus corrosion-resistant alloy of claim 7, being produced by using a manufacturing method selected from a group consisting of: vacuum arc melting method, electric resistance wire heating method, electric induction heating method, rapidly solidification method, mechanical alloying method, and powder metallurgic method.

11. The low modulus corrosion-resistant alloy of claim 7, wherein the low modulus corrosion-resistant alloy is processed to be an article selected from a group consisting of powder article, wire article, rod article, plate article, bulk article, and welding rod.

12. An article, being made of an alloy material, wherein the alloy material has a plurality of properties that comprises: hardness of at least 250 HV, Young's modulus in a range between 70 GPa and 100 GPa, yield strength greater than 600 MPa, and critical pitting potential greater than 1.3V, and comprising:

at least 40 weight percent Zr,
18.1 to 50 weight percent Nb,
13 to 40 weight percent Ti,
4 to 10 weight percent Mo,
1.5 to 15 weight percent Sn, and
at most 5 weight percent Fe;

wherein a summation of Zr and Ti in weight percent is less than or equal to 80;

wherein the article is selected from a group consisting of surgical implant, medical device and industrially-producible product; and wherein the forgoing industrially-producible product is selected from a group consisting of spring, coil, wire, clamp, fastener, blade, valve, elastic sheet, spectacle frame, and sports equipment.

* * * * *